US006990844B1

(12) United States Patent
Fidziukiewicz

(10) Patent No.: US 6,990,844 B1
(45) Date of Patent: Jan. 31, 2006

(54) NARROW AERIAL AND DIE-MOUNT CAMS

(75) Inventor: Erich D. Fidziukiewicz, South Lyon, MI (US)

(73) Assignee: Anchor Lamina America, Inc., Farmington Hills, MI (US)

( * ) Notice: Subject to any disclaimer, the term of this patent is extended or adjusted under 35 U.S.C. 154(b) by 0 days.

(21) Appl. No.: 10/899,601

(22) Filed: Jul. 27, 2004

(51) Int. Cl.
*B21D 5/04* (2006.01)
*B26D 5/16* (2006.01)

(52) U.S. Cl. ..... 72/452.9; 72/304; 72/315; 72/381; 83/635; 83/620

(58) Field of Classification Search ..... 72/452.9, 72/315, 319; 83/588, 627, 635
See application file for complete search history.

(56) References Cited

U.S. PATENT DOCUMENTS 5,101,705 A 4/1992 Matsuoka
5,231,907 A 8/1993 Matsuoka
5,269,167 A 12/1993 Gerhart et al.
5,347,838 A 9/1994 Matsuoka
5,487,296 A 1/1996 Gerhart et al.
5,746,082 A 5/1998 Matsuoka
5,784,916 A 7/1998 Matsuoka
5,884,521 A * 3/1999 Fidziukiewicz ..... 72/452.9
5,904,064 A * 5/1999 Higuchi ..... 72/459.9
5,931,074 A 8/1999 Matsuoka
6,250,177 B1 * 6/2001 Sasahara ..... 72/381

* cited by examiner

*Primary Examiner*—David B. Jones
(74) *Attorney, Agent, or Firm*—Brooks Kushman P.C.

(57) ABSTRACT

Narrow aerial and die-mount cams, each having a cam adapter, a driver and a slide sandwiched between the cam adapter and driver. The narrow aerial cam slide has an elongate primary portion that has a T-shaped cross-section and has a primary bearing surface, and the cam adapter has a rectangular recess. An elongate keeper plate having a longitudinal slot is secured to each side of the cam adapter adjacent the rectangular recess to slidably retain the primary portion of the slide within the longitudinal slots and the rectangular recess. The primary bearing surface and a pair of intermediate bearing surfaces formed in the slide below the primary portion slidably support the keeper plates and thus the cam adapter. The driver slidably supports the slide. The narrow die-mount cam is basically an inverted version of the aerial cam.

20 Claims, 3 Drawing Sheets

NARROW AERIAL AND DIE-MOUNT CAMS

BACKGROUND OF THE INVENTION

1. Field of the Invention

The invention relates generally to aerial and die-mount cams and more particularly to improvements in cams configured to provide an increased load-bearing capacity and to facilitate the fabrication of long-lived, narrow cams having components that do not require custom fitting.

2. Background Art

Aerial and die-mount cams are often used to operate tools for such manufacturing processes as punching, trimming, stamping and bending workpieces. These devices include elements that convert downward and upward forces provided by a press into laterally directed component forces that advance and retract a tool in lateral directions to effect the mentioned processes.

Since some manufacturing processes require the application of considerable forces, an important feature of cams is their load-bearing capacity. Cams in present use typically have a maximum load-bearing capacity of some 1.5 tons. Previous attempts to increase load-bearing capacity have included broadening bearing surfaces, but these have increased the width of the cams. Since cam size is a limiting factor that prohibits the use of certain cams in certain presses and for certain applications, it is thus another important feature in cam design and application.

A few of the attempts to increase load-bearing capacity of cams have included the introduction of laterally inclined bearing surfaces. These changes provided an advantage of increasing the stability of the cams as well as somewhat increasing their load-bearing capacities, but they were not directed toward reducing the lateral sizes of cams.

The wearing of parts that are in slidable contact with other parts is always a concern in mechanisms such as aerial and die-mount cams. Having to remove cams from their presses to replace worn parts can be a costly and time-consuming activity.

The structural integrity of joined parts is another important area of concern. Fasteners such as bolts that hold parts together are more likely to loosen or fail if they are placed under stress during press operation.

Many aerial and die-mount cams have configurations that are unique to their use in specific presses and for specific purposes. Their design and construction result in additional expenses.

SUMMARY OF THE INVENTION

An object of the present invention is to provide improved aerial and die-mount cams that have a more efficient load distribution. The improved load distribution enables the cams to be narrower and to bear an increased load.

In carrying out the foregoing object, the aerial and die-mount cams each include a driver, a slide and a cam adapter arranged in vertically stacked relation. The cams have slidably arranged bearing surfaces between the driver, slide and cam adapter supporting the same for relative sliding movement upon closing and opening of platens of a press between which the cam may be arranged.

Each of the slidably arranged bearing surfaces cooperatively extend continuously across the distance between opposite sides of the driver, slide and cam adapter. The loading on the cam is therefore distributed across the entire width of the cam.

At least a portion of the bearing surfaces spacedly overlap each other, and the bearing surfaces extending between opposite sides of the cam thereby cumulatively exceed the distance between the opposite sides. This facilitates the fabrication of cams that not only have greater load-bearing capacities but also cams that are narrower and whose slides have increased angular stability.

The driver has a driver bearing surface, and the slide has a primary portion and a secondary portion. The primary portion has a T-shaped cross-section and an elongate primary bearing surface, and the secondary portion has a secondary bearing surface in slidable contact with the driver bearing surface. The slide further has a pair of parallel and laterally spaced intermediate bearing surfaces located intermediate the primary bearing surface and the secondary bearing surface. The driver bearing surface is softer than the secondary bearing surface and is formed of self-lubricating material.

The cam adapter has a rectangular recess; and each of a pair of elongate keeper plates, each having a longitudinal slot, is secured to one side of the cam adapter adjacent the rectangular recess to slidably retain the primary portion of the slide within the longitudinal slots and the rectangular recess. The elongate keeper plates have bearing surfaces that slidably contact the primary portion, including the primary bearing surface, of the slide and further have bearing surfaces that slidably contact the intermediate bearing surfaces of the slide. Surfaces of the first and second elongate keeper plates that contact surfaces, including the primary bearing surface, of the primary portion and that contact the intermediate bearing surfaces of the slide are softer than the primary portion and the intermediate bearing surfaces of the slide and are formed of self-lubricating material.

The keeper plates are attached to the cam adapter with fasteners such as bolts, and the assembled configuration reduces the likelihood of the bolts being loosened or damaged by minimizing the strength of forces applied to them during cam operation. The configuration of the keeper plates and the disposition of the bolts facilitates the removal and installation of the keeper plates without requiring cam removal from the press.

The rectangular recess of the cam adapter has a forward stop and a rear stop between which the primary portion of the slide is driven, and the slide also has a resilient member extending toward the forward stop. The resilient member is compressed against the forward stop as the primary portion of the slide is advanced, and the resilient member provides a slide-retracting force when the resilient member is allowed to decompress. The slide also has a shock absorber extending toward the rear stop of the rectangular recess to decelerate the slide as the slide nears a fully retracted position.

The driver has an elongate slot that extends along a portion of each side at the same angle to the horizontal as those of the driver bearing surface and the secondary bearing surface of the slide. A positive return member is secured to each side of the slide, and each positive return member has a projection that is slidably received by one of the elongate slots.

The driver bearing surface and the secondary bearing surface of the slide of the aerial cam each has an inverted V-shape that slidably conforms to the other. The driver bearing surface and the secondary bearing surface of the slide of the die-mount cam each has a V-shape that slidably conforms to the other.

The aerial and die-mount cams are basically inverted versions of each other. Efficiencies of assembly and installation and reduced expenses can be realized by using cam adapters, slides and drivers that have components that do not require custom fitting. The self-lubricating material on one of each pair of bearing and contacting surfaces extend the life of contacting surfaces that slide relative to one another.

DETAILED DESCRIPTION OF THE PREFERRED EMBODIMENT(S)

Figure 5:
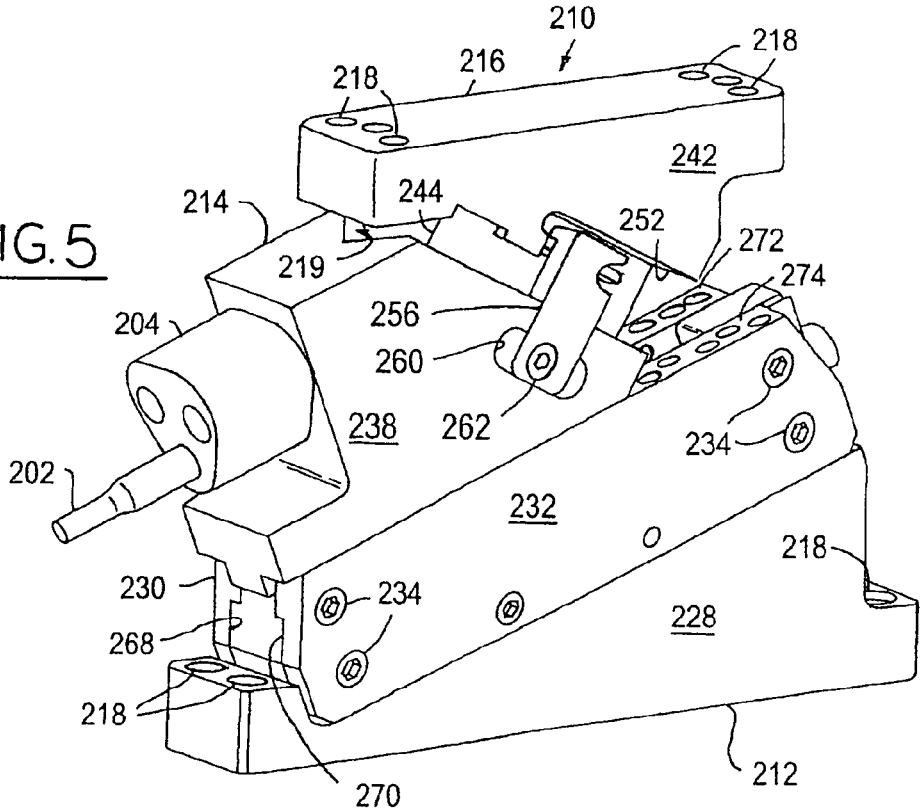
FIG. 5 is a perspective view, partially broken away, of a die-mount cam and illustrates an inverted and similar version, taken from a different perspective and including a tool holder and a representative tool, of the aerial cam of FIG. 1.
Figure 4:
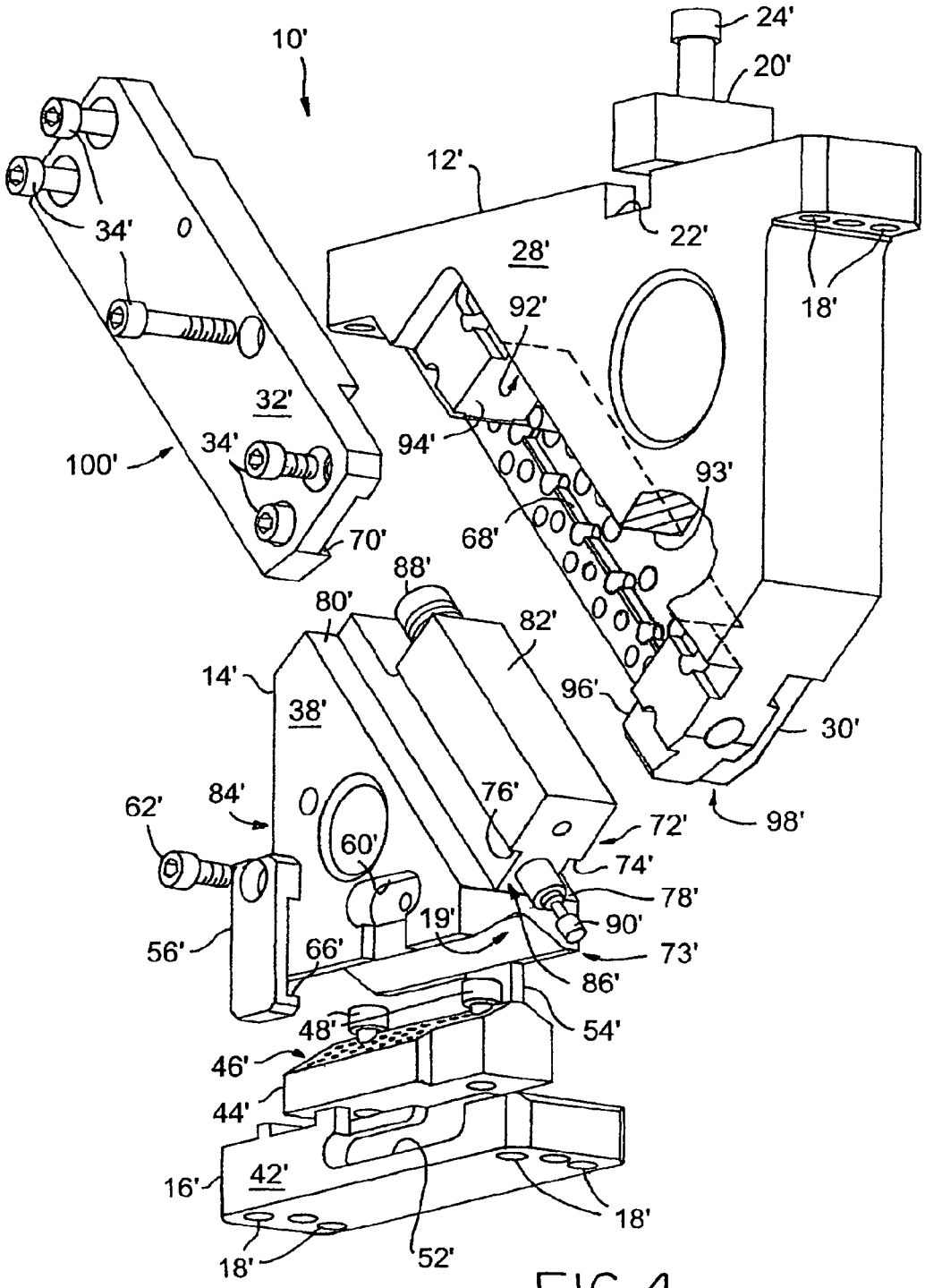
FIG. 4 is an exploded, perspective view, showing a gas spring and interior details, of the aerial cam of FIG. 2, the cam shown having an uninclined driver.

It should be noted that, when the term "cam" is used in this specification without particular reference to the type of cam, the term refers inclusively to aerial cams and die-mount cams. It should be further noted that FIGS. 1, 2, 3 and 5 do not show inner details of the cams. FIG. 4, however, is an exploded view that does reveal details of the inner structures. FIGS. 4 and 5 show only one side of each cam represented, but the respective opposite sides and the components and features located there are mirror images of the components and features located on the sides shown.

Figure 1:
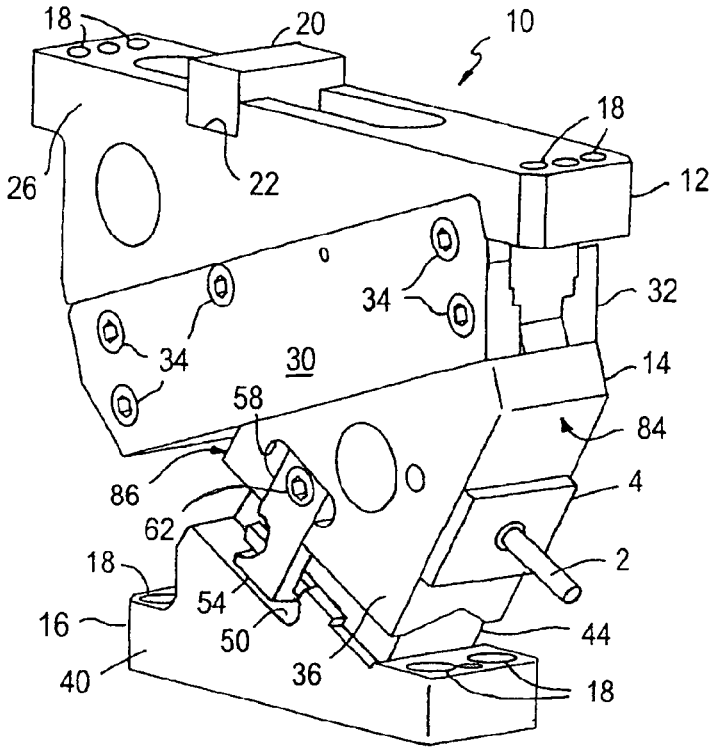
FIG. 1 is a perspective view, partially broken away, of an aerial cam and illustrates a combination of a cam adapter, a slide, keeper plates, a V-block and a driver, the driver being inclined.
Figures 2, 3:
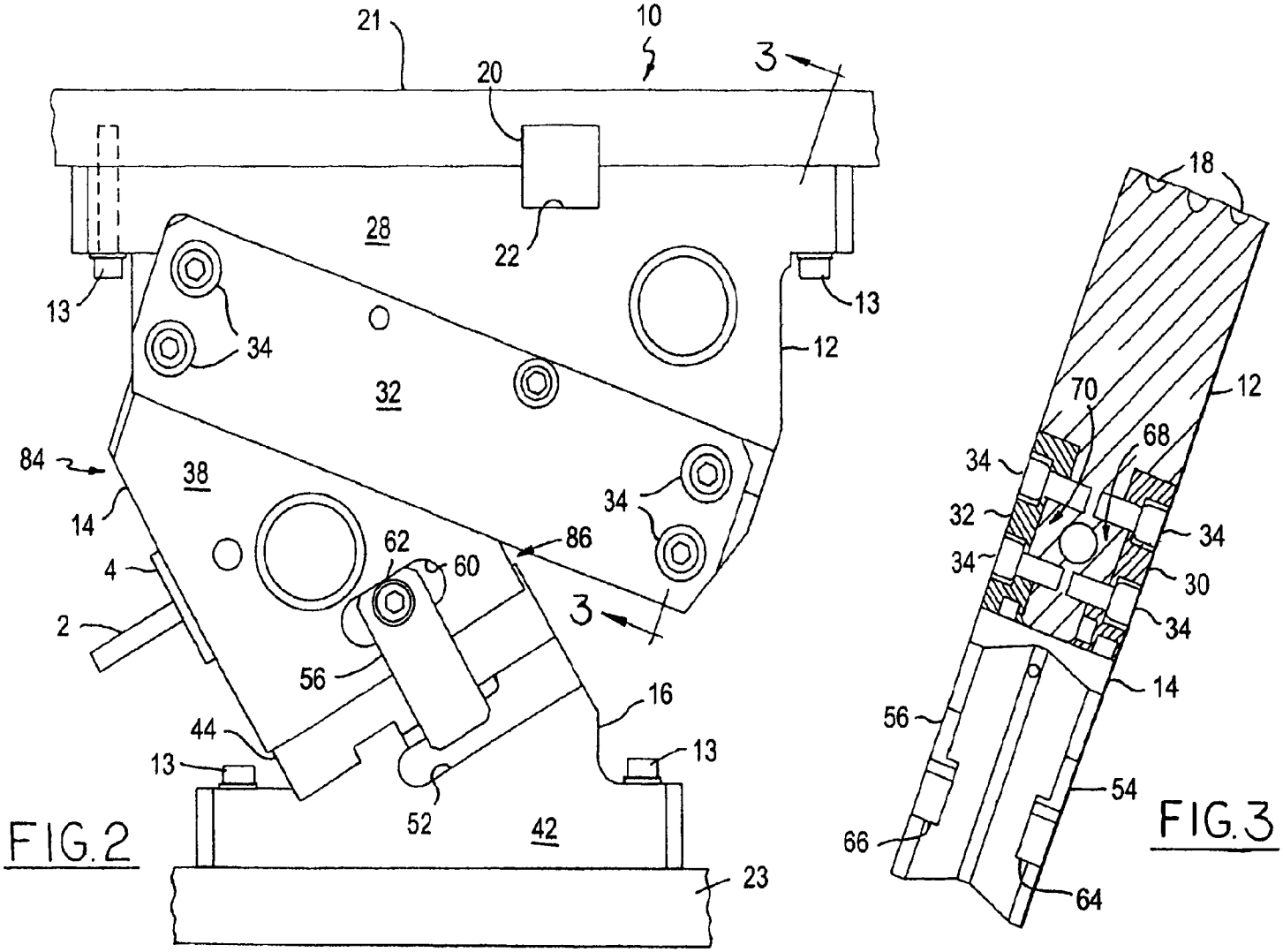
FIG. 2 is a side view, showing the opposite side, of the aerial cam of FIG. 1.
FIG. 3 is a partial cross-sectional view, taken on the line 3—3, of the aerial cam of FIG. 2.

FIG. 1 is a perspective view of a front and first side of a representative narrow aerial cam, generally indicated by the reference numeral 10, that includes a cam driving member, or cam adapter, 12, a tool holding member, or slide, 14, and a driver 16. The cam adapter 12 is secured, typically by bolts 13 (FIG. 2) passing through bolt holes 18, to an upper platen 21 (FIG. 2) of a press (not shown). To facilitate properly aligning the cam adapter 12, the latter has a key 20 that is secured within a keyway 22 by a fastener such as a bolt 24 (FIG. 4). The key 20 is received within a mating keyway within the upper platen 21 (FIG. 2). The driver 16 is secured, by fasteners such as bolts 13 (FIG. 2) passing through bolt holes 18, to a lower platen 23 (FIG. 2) of the press (not shown). Efficiencies of assembly and installation and reduced expenses can be realized by using cam adapters 12, slides 14 and drivers 16 that have components that do not require custom fitting.

Also shown by FIG. 1 are first sides, 26, 36 and 40 of the cam adapter 12, the slide 14 and the driver 16 respectively. A first elongate keeper plate 30 is attached to the first side 26 of the cam adapter 12 by fasteners such as bolts 34. A V-block 44, having an inverted-V-shaped driver bearing surface, generally indicated by the reference numeral 46' (FIG. 4), is secured atop the driver 16 by fasteners such as bolts 48' (FIG. 4), and slidably supports the slide 14. The slide 14 has a front end 84 and a rear end 86. A representative tool 2 is shown mounted on the front end 84 of the slide 14 with a representative tool holder 4. The slide 14 has an inverted V-shaped secondary bearing surface, generally indicated by the reference numeral 19' (FIG. 4) that conforms to the driver bearing surface 46' of the V-block 44'. The driver bearing surface 46' (FIG. 4) of the driver 16 upon which the slide 14 is slidably supported is inclined at an acute angle to the horizontal, and the driver 16 has a first elongate slot 50 that extends at the same acute angle to the horizontal. A first positive return member 54 (shown partially broken away) is secured within a first recess 58 to the first side 36 of the slide 14 by a fastener such as a bolt 62. At an end distal from the bolt 62 securing the first positive return member 54 to the slide 14, the first positive return member 54 has a generally rectangular first projection 64 (see FIG. 3 and the second projection 66', FIG. 4) that slidably extends into the first elongate slot 50.

FIG. 2 is a view of a second, opposite side of the narrow aerial cam 10 of FIG. 1. The components and features located on the second side of the narrow aerial cam 10 are mirror images of those of the first side, and their functions are the same as previously described for their respective counterparts on the first side. Shown are second sides, 28, 38 and 42 of the cam adapter 12, the slide 14 and the driver 16 respectively. A second elongate keeper plate 32 is attached to the second side 28 of the cam adapter 12. The driver 16 has a second elongate slot 52, which is inclined at the same acute angle to the horizontal as that of the first elongate slot 50 of FIG. 1. A second positive return member 56 is secured to the second side 38 of the slide 14.

FIG. 3 is a rear view of the narrow aerial cam 10 of FIG. 2, shown partially in cross-section, taken on the line 3-3 of FIG. 2. It shows the cam adapter 12 and the first and second elongate keeper plates 30 and 32, in section, attached to the cam adapter 12 and also indicates respective first and second longitudinal slots 68 and 70 in the elongate keeper plates 30 and 32. Also shown is a rear-end view of the slide 14 and first and second positive return members, 54 and 56 respectively, and respective first and second projections 64 and 66 extending respectively from the first and second positive return members 54 and 56. Bolts 34 securing the first and second elongate keeper plates 30 and 32 to the cam adapter 12 are also represented. The assembled configuration reduces the likelihood of the bolts 34 being loosened or damaged by minimizing the strength of forces applied to them during cam operation. The configuration of the elongate keeper plates 30 and 32 and the disposition of the bolts 34 facilitates the removal and installation of the elongate keeper plates 30 and 32 without having to remove the cam 10 from the press (not shown).

Except for having a driver 16' with an uninclined driver bearing surface 46' rather than an inclined driver bearing surface as with the driver 16 (FIG. 2) and having a slide 14' with an uninclined secondary bearing surface 19' rather than an inclined secondary bearing surface as with the slide 14 (FIG. 2), a narrow aerial cam 10' shown by FIG. 4 would be similar to an exploded, perspective view of the narrow aerial cam 10 of FIG. 2. As mentioned previously, FIG. 4 shows only one side of the aerial cam represented, but the opposite side and the components and features located there are a mirror image of the second side and the components and features located there. Shown by FIG. 4 are second sides, 28', 38' and 42' of the cam adapter 12', the slide 14' and the driver 16' respectively. A first elongate keeper plate 30' is attached to the first side (not shown) of the cam adapter 12', and a second elongate keeper plate 32' is attached to the second side 28' of the cam adapter 12' by fasteners such as bolts 34'.

A V-block 44', having an inverted-V-shaped driver bearing surface, generally indicated by the reference numeral 46', is secured atop the driver 16' by fasteners such as bolts 48', and slidably supports the slide 14'. The driver bearing surface 46' of the V-block 44' upon which the slide 14' is slidably supported is softer than the secondary bearing surface 19' of the slide 14' and is preferably formed of self-lubricating material. The driver bearing surface 46' is uninclined to the horizontal, and the driver 16' has a second elongate slot 52' that is also uninclined to the horizontal. A second positive return member 56' is secured within a second recess 60' to the second side 38' of the slide 14' by a fastener such as a bolt 62'. At an end distal from the bolt 62' securing the second positive return member 56' to the slide 14', the second positive return member 56' has a generally rectangular second projection 66' that slidably extends into the second elongate slot 52'.

As revealed by the exploded view of FIG. 4, the slide 14' includes an elongate primary portion, generally indicated by the reference numeral 72', having a generally T-shaped cross section that delineates first and second longitudinal slots, 74' and 76' respectively. The slide also includes a secondary portion, generally indicated by the reference numeral 73', which includes the secondary bearing surface 19' in slidable contact with the driver bearing surface 46' of the V-block. The slide 14' has a front end 84' and a rear end 86'. Extending from the front end 84' of the elongate primary portion 72' of the driver 14' is a resilient member, preferably a gas spring, 88'; and extending from the rear end 86' is a shock absorber 90'. The cam adapter 12' has a rectangular recess, generally indicated by the reference numeral 92', that slidably receives the elongate primary portion 72' of the slide 14'. One end of the rectangular recess 92' acts as a forward stop 94' against which the gas spring 88' is compressed when the slide 14 is advanced. The opposite end of the rectangular recess 92' acts as a rear stop 96' against which the shock absorber 90' is compressed when the slide 14 is retracted.

The mutually inwardly facing inner bearing surfaces of the first and second elongate keeper plates, 30' and 32' respectively, have first and second longitudinal slots 68' and 70' that slidably receive the generally rectangular elongate primary portion 72' of the slide 14'. The configuration of the primary portion 72' and of the intermediate bearing surfaces 78' and 80' of the slide and their cooperation with the rectangular recess bearing surface of the cam adapter 12' and with the bearing surfaces of the elongate keeper plates 30' and 32' contribute to the increased load-bearing capacity of the cam and to an increased lateral and angular stability of the slide 14' of the cam. The slide 14' has three bearing surfaces that receive downward forces from the cam adapter 12' and the elongate keeper plates 30' and 32' when the cam adapter 12' is forced downwardly by the upper platen 21 of the press (not shown). The top of the elongate primary portion 72' forms an elongate primary bearing surface 82'; and lower bearing surfaces of the first and second elongate slots 74' and 76' extend laterally to form first and second intermediate bearing surfaces, 78' and 80' respectively.

The elongate primary bearing surface 82' receives downward forces from upper edges of the first and second longitudinal slots 68' and 70' of the first and second elongate keeper plates 30' and 32'. The first and second intermediate bearing surfaces 78' and 80' receive forces respectively from the first and second lower bearing surfaces 98' and 100' of the first and second elongate keeper plates 30' and 32'.

As represented by portions shown by FIG. 4 of the first elongate keeper plate 30', portions of the inner bearing surfaces, including the bearing surfaces of the first and second longitudinal slots 68' and 70', of the first and second elongate keeper plates 30' and 32' are formed of material that is softer than the bearing surfaces of the upper portion 72' of the slide 14' and are preferably formed of self-lubricating material. First and second lower bearing surfaces 98' and 100' of the first and second elongate keeper plates, 30' and 32' respectively (similar to the first and second upper bearing surfaces 272 and 274 shown by FIG. 5), have softer bearing surfaces than the respective first and second intermediate bearing surfaces 78' and 80' of the slide 14' and are preferably formed of self-lubricating material.

The bearing surfaces cooperatively extend continuously across the distance between opposite sides of the driver, slide and cam adapter, distributing loads across the entire width of the cam. Moreover, as shown best by FIG. 4, in the aerial cam shown, a portion of the elongate primary bearing surface 82' spacedly overlaps a portion of each of the first and second intermediate bearing surfaces 78' and 80', and it also spacedly overlaps a portion of the driver bearing surface 46 of the V-block 44'. The first and second intermediate bearing surfaces 78' also spacedly overlap portions of the driver bearing surface 46 of the V-block 44'. In the die-mount cam shown by FIG. 5, the secondary bearing surface 219 of the slide 214 spacedly overlaps portions of the first and second upper bearing surfaces 272 and 274 of the first and second elongate keeper plates, 230 and 232 respectively, and spacedly overlaps the bearing surface (not shown but similar to an inverted rectangular recess bearing surface 93' of the rectangular recess shown by FIG. 4).

The portions of bearing surfaces overlapped represent bearing surfaces in excess of those necessary to cooperatively extend continuously across the distance between opposite sides of the driver, slide and cam adapter; and they do so without adding to the overall width of the cam. These features facilitate the fabrication of cams that are narrower and whose slides have increased angular stability. The configuration provides the cams of the present invention with a load-bearing capacity of some 4 tons.

The narrow aerial cam 10' shown by FIG. 4 will now be used as a representative example of the aerial cams shown by FIGS. 1, 2, 3 and 4 in describing their operation. When the cam adapter 12' is pressed downwardly by the upper platen 21 (FIG. 2) of the press (not shown), an attending downward force is exerted upon the first and second elongate keeper plates 30' and 32' secured to the cam adapter 12'. The first and second keeper plates 30' and 32' communicate the attending force to the inclined elongate primary bearing surface 82' of the slide 14' and to the likewise inclined intermediate bearing surfaces 78' and 80' of the slide 14'. A component of the downward force exerted upon the inclined elongate primary bearing surface 82' and the inclined intermediate bearing surfaces 78' and 80' advances the slide 14' along the driver bearing surface 46' of the V-block 44'. Due to the relative motions of the cam adapter 12' and the slide 14', as the cam adapter 12' is forced downwardly by the upper platen 21 of the press (not shown), the gas spring 88' is compressed against the forward stop 94' within the rectangular recess 92' of the cam adapter 12'.

At an end distal from the bolt 62' securing the second positive return member 56' to the slide 14', the second positive return member 56' has a generally rectangular second projection 66' that slidably extends into the second elongate slot 52' of the driver 16'. A first generally rectangular projection (not shown but a mirror image of the second projection 66') slidably extends from a first positive return member 54' into a first elongate slot (not shown but a mirror image of the second elongate slot 52') in the driver 16'.

When the slide 14' is to be retracted, the cam adapter 12' shown by FIG. 4 is forced upwardly by the platen 21 of the press (not shown). The generally rectangular elongate primary portion 72' of the slide 14', which is slidably contained within the rectangular recess 92' of the cam adapter 12' and the first and second longitudinal slots 68' and 70' of the first and second elongate keeper plates 30' and 32', is pulled upwardly. The inclined disposition of the bearing surfaces supporting the elongate primary portion 72' of the slide 14' within the rectangular recess 92' results in a component of the vertical force that is pulling the cam adapter 12' upwardly being directed laterally to retract the slide 14'. The component force acting to retract the slide 14' is supplemented by a force provided by the gas spring 88' as it decompresses.

Likewise, with reference to FIGS. 1 and 2, when the cam adapter 12 is forced upwardly by the upper platen 21 of the press (not shown), the slide 14 is retracted by component forces applied to the slide 14 by the first and second elongate keeper plates 30 and 32 and by the decompressing gas spring 88' (FIG. 4). An upwardly directed component of the force applied to the slide 14 by the first and second elongate keeper plates 30 and 32 is also communicated to the first and second positive return members 54 and 56, which are secured to the slide 14. When the projections (see second projection 66' of FIG. 4) extending from the first and second positive return members 54 and 56 are forced upwardly within the first and second, stationary, inclined, elongate slots 50 and 52 respectively, the positive return members 54 and 56 force the slide 14 to retract even if the forces applied to the slide 14 by the first and second elongate keeper plates 30 and 32 and by the decompressing gas spring 88' (FIG. 4) fail to do so. The first and second positive return members 54 and 56 also limit the separation of the slide 14 from the driver 16.

FIG. 5 is a perspective view of a narrow die-mount cam, generally indicated by the reference numeral 210. It is essentially an inverted version the narrow aerial cam 10 shown by FIG. 1, shown from a different perspective. As mentioned previously, FIG. 5 shows only one side of the cam represented, but the opposite side and the components and features located there are a mirror image of the respective components and features located on the side shown. The narrow die-mount cam 210 includes a cam driving member, or cam adapter, 212, a tool holding member, or slide, 214, and a driver 216. The cam adapter 212 is secured, typically by bolts 13 (FIG. 2) passing through bolt holes 218, to the lower platen 23 (FIG. 2) of the press (not shown). The driver 216 is secured, by fasteners such as bolts 13 (FIG. 2) passing through bolt holes 218, to the upper platen 21 (FIG. 2) of the press (not shown).

Also shown by FIG. 5 are second sides 228, 238 and 242 of the cam adapter 212, the slide 214 and the driver 216 respectively. A first elongate keeper plate 230 is attached to a first side (not shown but a mirror image of the second side 228) of the cam adapter 212; and a second elongate keeper plate 232 is attached to the second side 228 of the cam adapter 212 by fasteners such as bolts 234. A V-block 244, having a V-shaped driver bearing surface (see driver bearing surface 46', FIG. 4), is secured below the driver 216, and is slidably supported by the slide 214. The slide 214 has a V-shaped secondary bearing surface, generally indicated by the reference numeral 219, that conforms to the driver bearing surface of the V-block 244. The driver bearing surface of the driver 216 that is slidably supported by the slide 214 is inclined at an acute angle to the horizontal, and the driver 216 has a second elongate slot 252 that extends at the same acute angle to the horizontal. A second positive return member 256 is secured within a second recess 260 to the second side 238 of the slide 214 by a fastener such as a bolt 262. At an end distal from the bolt 262 securing the second positive return member 256 to the slide 214, the second positive return member 256 has a generally rectangular first projection (see second projection 66', FIG. 4) that slidably extends into the second elongate slot 252.

The slide 214 is configured to support a tool holder 204 that is capable of holding any of a number of well-known tools such as a representative punch 202 shown. The cam adapter 212, being on the bottom, slidably supports the slide 214, which in turn slidably supports the driver 216. The components and features of the opposite side of the narrow die-mount cam 210 shown by FIG. 5 are mirror images of those of the side shown.

As described for elements of the cams shown by previous figures, similar respective bearing surfaces that are not exposed by FIG. 5 are harder or softer relative to another upon which it slides. As described previously, the softer bearing surfaces, for example, first and second upper bearing surfaces, 272 and 274 respectively, of the first and second elongate keeper plates 230 and 232 are preferably formed of self-lubricating material.

The operation of the die-mount cam 210 is similar to that of the aerial cam 10. As the driver 216 is forced downwardly by the upper platen 21 of the press (not shown) and the slide 214 advances along the cam adapter 212, the tool 202 (FIG. 5) secured to the slide 214 by a tool holder 204 (FIG. 5) is advanced toward a workpiece (not shown). When the driver 216 is forced upwardly by the platen 21 of the press (not shown), the slide 214 and tool 202 are retracted. The advancement and retraction of the slide 214 are accomplished as described for slides shown by the previous figures.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A narrow aerial or die-mount cam for use in confined spaces, comprising:

a driver, a slide and a cam adapter arranged in vertically stacked relation;

slidably arranged bearing surfaces disposed between the driver, slide, and cam adapter supporting the same for relative sliding movement upon closing and opening of platens of a press between which the cam may be arranged; and each of the slidably arranged bearing surfaces cooperatively extending continuously across the entire distance between opposite sides of the driver, slide and cam adapter, whereby the loading thereon is distributed at least across the entire width of the cam.

2. The invention defined by claim 1, wherein at least a portion of the bearing surfaces spacedly overlap, the bearing surface extending between opposite sides of the cam thereby cumulatively exceeding the distance between the opposite sides.

3. The invention defined by claim 2, wherein the driver has a driver bearing surface.

4. The invention defined by claim 3, wherein the slide comprises a primary portion and a secondary portion, the primary portion having a T-shaped cross-section and an elongate primary bearing surface, the secondary portion having a secondary bearing surface in slidable contact with the driver bearing surface, the slide further having a pair of parallel and laterally spaced intermediate bearing surfaces located intermediate the primary bearing surface and the secondary bearing surface.

5. The invention defined by claim 4, wherein the driver bearing surface is softer than the secondary bearing surface and is formed of self-lubricating material.

6. The invention defined by claim 4, wherein the cam adapter has a rectangular recess having a rectangular recess bearing surface in slidable contact with the primary bearing surface of the slide.

7. The invention defined by claim 6, wherein the recess bearing surface is softer than the elongate primary bearing surface of the elongate primary portion of the slide and is formed of self-lubricating material.

8. The invention defined by claim 6, further including a pair of elongate keeper plates, each having a longitudinal slot and each being secured to one side of the cam adapter adjacent the rectangular recess to slidably retain the primary portion of the slide within the longitudinal slots and the rectangular recess, the elongate keeper plates having bearing surfaces that slidably contact the primary portion, including the primary bearing surface, of the slide and further having bearing surfaces that slidably contact the intermediate bearing surfaces of the slide.

9. The invention defined by claim 8, wherein surfaces of the first and second elongate keeper plates that contact surfaces, including the primary bearing surface, of the primary portion and that contact the intermediate bearing surfaces of the slide are softer than the primary portion and the intermediate bearing surfaces of the slide and are formed of self-lubricating material.

10. The invention defined by claim 8, wherein the rectangular recess of the cam adapter has a forward stop and a rear stop between which the primary portion of the slide is driven, and the slide further comprises a resilient member extending toward the forward stop, the resilient member being compressed against the forward stop as the primary portion of the slide is advanced, the resilient member providing a slide-retracting force when the resilient member is allowed to decompress.

11. The invention defined by claim 10, wherein the resilient member is a gas spring.

12. The invention defined by claim 10, the slide further comprising a shock absorber extending toward the rear stop of the rectangular recess to decelerate the slide as the slide nears a fully retracted position.

13. The invention defined by claim 10, wherein the driver has an elongate slot that extends along a portion of each side at the same angle to the horizontal as those of the driver bearing surface and the secondary bearing surface of the slide.

14. The invention defined by claim 13, further comprising a positive return member secured to each side of the slide, each positive return member having a projection, each elongate slot slidably receiving one of the projections.

15. The invention defined by claim 14, wherein the driver bearing surface and the secondary bearing surface of the slide of the aerial cam each has an inverted V-shape that slidably conforms to the other.

16. The invention defined by claim 15, wherein the inverted V-shaped bearing surface of the driver is formed of self-lubricating material.

17. The invention defined by claim 16, wherein the inverted V-shaped bearing surface of the driver is provided by a separate inverted V-block secured to the driver.

18. The invention defined by claim 14, wherein the driver bearing surface and the secondary bearing surface of the slide of the die-mount cam each has a V-shape that slidably conforms to the other.

19. The invention defined by claim 18, wherein the V-shaped bearing surface of the driver is formed of self-lubricating material.

20. The invention defined by claim 19, wherein the V-shaped bearing surface of the driver is provided by a separate V-block secured to the driver.

* * * * *